US005263388A

United States Patent [19]

Beuke

[11] Patent Number: 5,263,388

[45] Date of Patent: Nov. 23, 1993

[54] POWER WRENCH

[75] Inventor: Karl Beuke, Neunkirchen, Fed. Rep. of Germany

[73] Assignee: Paul-Heinz Wagner, Much, Fed. Rep. of Germany

[21] Appl. No.: 989,465

[22] Filed: Dec. 10, 1992

Related U.S. Application Data

[63] Continuation of Ser. No. 853,381, Mar. 18, 1992, abandoned.

[30] Foreign Application Priority Data

Apr. 10, 1991 [DE] Fed. Rep. of Germany ..... 411631

[51] Int. Cl.[5] ..... B25B 13/46

[52] U.S. Cl. ..... 81/57.39; 92/172; 81/57.44

[58] Field of Search ..... 92/172, 174, 177, 178; 81/57.39, 57.44, 57.4

[56] References Cited

U.S. PATENT DOCUMENTS

| | | | |
|---|---|---|---|
| 2,710,137 | 6/1955 | Arnouil | 92/172 X |
| 4,201,099 | 5/1980 | Junkers . | |
| 4,246,833 | 1/1981 | Burklund | 92/172 X |
| 4,619,160 | 10/1986 | Meyer . | |
| 4,765,292 | 8/1988 | Morgado | 92/172 X |
| 4,805,496 | 2/1989 | Wagner et al. | 81/57.39 |
| 4,825,730 | 5/1989 | Junkers . | |
| 4,854,197 | 8/1989 | Walton | 81/57.39 |
| 4,982,626 | 1/1991 | More et al. | 81/57.39 |
| 5,003,847 | 4/1991 | Wagner | 81/57.39 |

*Primary Examiner*—D. S. Meislin
*Attorney, Agent, or Firm*—Diller, Ramik & Wight

[57] ABSTRACT

A power wrench comprises a ring member for connection to the screw head to be rotated, the ring member being rotated with an engaging lever. The ratchet lever is driven by the piston rod of a piston. The piston has a convex circumferential surface so that it may be tilted within the cylinder in order to adapt to different orientations of the piston rod.

8 Claims, 1 Drawing Sheet

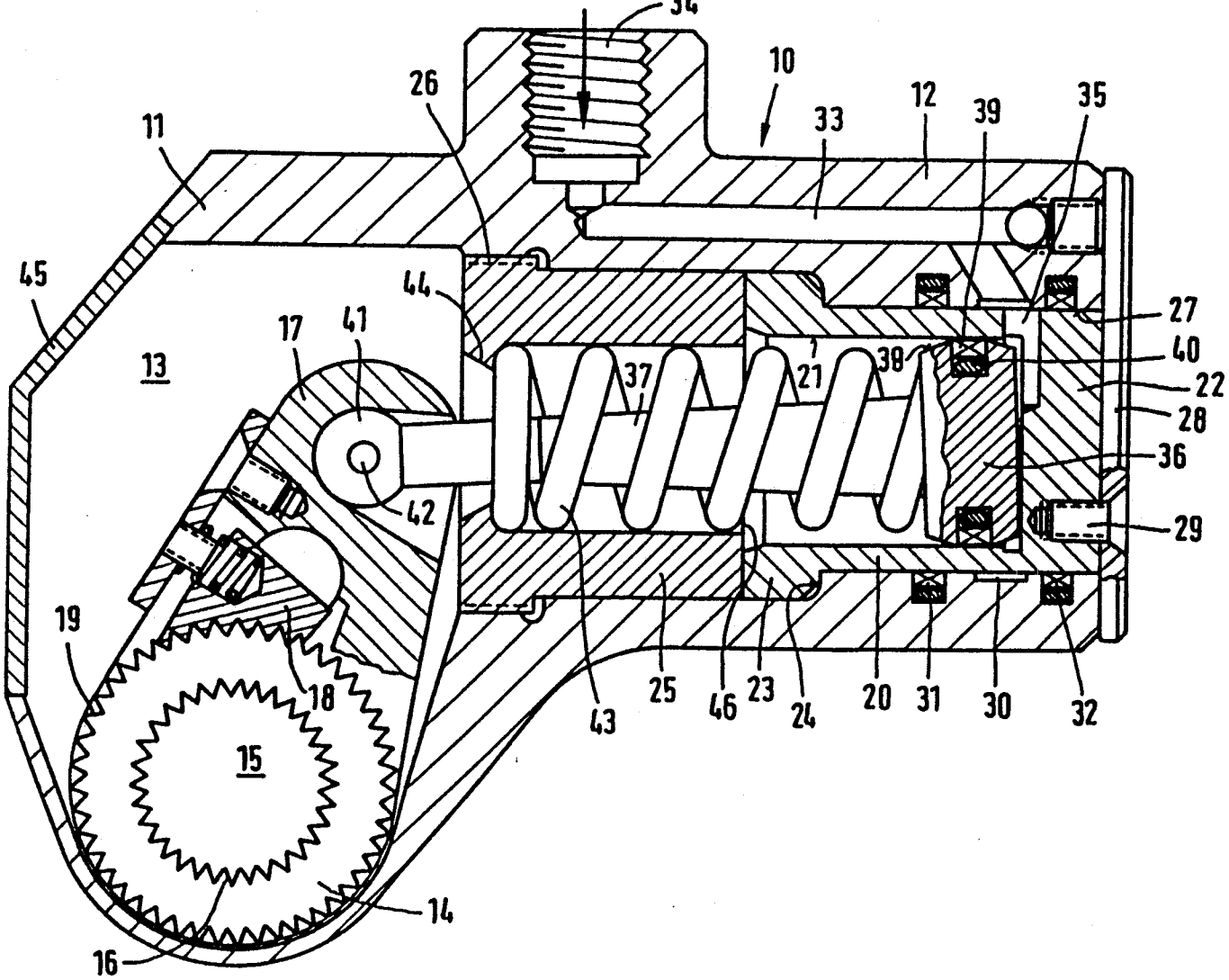
10
11
12
13
14
15
16
17
18
19
20
21
22
23
24
25
26
27
28
29
30
31
32
33
34
35
36
37
38
39
40
41
42
43
44
45
46

POWER WRENCH

This application is a continuation of application Ser. No. 07/853,381, filed Mar. 18, 1992, now abandoned.

BACKGROUND OF THE INVENTION

The present invention refers to a pressure medium operated power wrench for turning screws, nuts and the like.

A power wrench is known from U.S. Pat. No. 4,201,099 which has a rotatable ring member within a housing, the ring member being adapted to be connected with the screw head to be turned so as to be rotatable therewith. The ring member is rotated intermittently by a ratchet dog that is reciprocated by a piston movable within a cylinder. A piston rod is connected to the piston by a joint situated within the piston and its other end is connected through a joint to the ratchet dog. By this pendulous mounting of the piston rod, the same is apt to adapt to the different pivotal positions of the ratchet dog relative to the axis of the ring member. The piston has a cylindrical circumferential surface with two sealing rings placed in sealing grooves so that the axis of the piston always coincides with the cylinder axis. It is a drawback of this structure that mounting the piston rod to the piston by joints requires a considerable technical effort and several parts that have to be made separately and assembled thereafter. The individual parts, like the sphere of the joint, the ball cup or the clamping ring of the ball are technically difficult to manufacture with the required high precision.

SUMMARY OF THE INVENTION

It is the object of the present invention to provide a power wrench consisting of few parts, being easy to manufacture and being suited to be manufactured with small dimensions.

In the power wrench of the present invention, the piston that sealingly abuts the cylinder wall, has a convex circumferential surface, preferably of spherical design. Thus, it is possible to tilt the piston while maintaining the sealing engagement at the cylinder wall so that the piston axis may take different orientations relative to the cylinder axis. The piston rod is rigidly mounted to the piston. The other end of the piston rod is connected to an engaging lever via a hinge joint. The hinge joint moves along a circle around the axis of rotation of the engaging lever and its position not only determines the orientation of the piston rod but also the orientation of the piston fixedly connected thereto.

It is an essential advantage of the present invention that the piston and the piston rod may be formed as an integral part so that the manufacturing and assembly efforts of the overall power wrench are reduced substantially. Furthermore, the axial length of the piston may be reduced whereby the dimensions of the housing in the axial direction of the cylinder may be maintained small.

Preferably, the cylinder is a replaceable cylinder bushing inserted into the housing. Suitably, this cylinder bushing is fittingly inserted into a corresponding bore of the housing. The replaceable cylinder bushing offers the advantage that if the cylinder surface is damaged by intruding foreign particles, only the cylinder bushing must be replaced. It is a further advantage that the cylinder bushing resists the working pressure and that the housing forms an additional protection against rupture that will become effective when the cylinder bushing breaks. Due to the clearancefree adaptation of the cylinder bushing to the housing, the cylinder bushing is held rigidly.

Preferably, the cylinder bushing is supported by a supporting bushing. This supporting bushing may simultaneously support a spring urging the piston into the retracted position.

The following is a detailed description of an embodiment of the present invention with reference to the sole FIGURE.

BRIEF DESCRIPTION OF THE DRAWING

The FIGURE is a schematic longitudinal section of the power wrench.

DESCRIPTION OF THE PREFERRED EMBODIMENTS

The power wrench has an integral housing 10 of steel, consisting of a head piece 11 and a drive piece 12. The head piece 11 has a working space 13 defined by two parallel plate-like walls. The ring member 14 is rotatably supported in these walls. The ring member 14 is a tubular element having a passage 15 with a profiled toothing 16. From either side, the shaft of a button die placed onto the screw head to be rotated may be inserted into the passage 15. This shaft has an outer toothing corresponding to the profiled toothing 16 so that the screw head is connected to the ring member 14 such that it rotates therewith.

Supported on the ring member 14, there is the engaging lever 17 having a spring-loaded ratchet element 18 that may engage a catch toothing 19 of the ring member 14. The ratchet element 18 is arranged and supported at the engaging lever 17 such that the engaging lever 17 will only pull along the ring member 14 in one direction of rotation, while it may be retracted in the other direction of rotation without rotating the ring member.

In the drive portion 12 of the housing 10, a cylinder bushing 20 is arranged within a bore, the bore of the cylinder bushing forming the cylinder 21. At the end averted from the engaging lever 17, the cylinder bushing 20 has a closed bottom 22, while the opposite end thereof is provided with an outwardly projecting annular flange 23 supported at an inner annular shoulder 24 of the housing.

A supporting bushing 25, inserted into the working portion 12 from the working space 13, presses the cylinder bushing 20 against the annular shoulder 24, thereby fixing the same in the axial direction. By an external thread 26, the supporting bushing 25 is threaded into an inner thread of the housing.

The stepped bore 27 into which the cylinder bushing 20 and the supporting bushing 25 are inserted, is open at the outer end of the drive portion 12 of the housing where it is closed by a screwed-on cover 28. A screw 29, screwed through the cover 28 into the cylinder bottom 22, serves as a contrivance against the rotation of the cylinder bushing.

In the bore 27, an annular groove 20 is provided, on both sides of which seals 31 and 32 are arranged in sealing grooves. The annular groove 30 communicates with a pressure channel 33 extending through the housing and leading to a pressure connection 34 of the housing 10. A bore 35 leads from the annular groove 35 through the wall of the cylinder bushing 20 to the vicinity of the bottom of the cylinder 21.

Within the cylinder 21, there is the piston 36 to which the piston rod 37 is attached rigidly. The circumferential surface 38 of the piston is convex. In detail, the circumferential surface 38 has a spherical shape, i.e. it is spherically curved around the center of the piston. In the equator of the circumferential surface 38, a sealing groove with a sealing ring 39 is provided. The sealing ring 39 is supported by a radially resilient supporting ring 40 that is arranged within the groove. The sealing ring 39 is rectangular in cross section and its outer surface flatly abuts the cylinder wall, while its front end faces abut the flanks of the sealing groove of the piston.

The end of the piston rod 37 averted from the piston is connected to the engaging lever 17 through a joint with a joint axis 42. Upon a pivoting of the engaging lever 17, the joint axis 42 moves about the axis of the ring ,member 14. The axis of the cylinder 21 is generally normal to the axis of the ring member 14.

Upon an axial movement of the piston 36 within the cylinder 21, the engaging lever 17 is pivoted thereby. The piston rod 37 changes its orientation relative to the axis of the cylinder 21, whereby the piston 36 is tilted in the manner illustrated. Despite this tilted position, the seal between the piston and the wall of the cylinder 21 is maintained.

The piston 36 is advanced in the cylinder 21 by hydraulic pressure supplied to the connection 35. Thereby, the engaging lever 17 is pivoted and the ratchet element pulls the ring member 14 along. The piston movement is limited by the piston 36 abutting against the front end abutment 46 of the supporting bushing 25.

The rearward movement of the piston 36 is effected by a spring 43 supported at an inner flange 44 of the supporting bushing 25 and surrounding the piston rod 37. The other end of the spring 43 abuts against the frontward piston surface. The inside of the supporting bushing 25 provides the space for receiving the compressed spring.

The working space 13 of the housing 10 is closed by a cover 45. With the cover removed, the parts of the power wrench may be mounted inside the housing through the corresponding opening, including those parts that are located in the drive portion 12.

When the spring 43 presses the piston 36 into the retracted position, the piston rod 37 also pulls along the engaging lever 17 via the joint axis 42, yet there is no pulling along of the ring member 14 by the engaging lever, due to the ratchet.

I claim:

1. A power wrench comprising a housing, a ring member, means mounting said ring member for rotation about an axis thereof, said housing further including a cylinder having an axis generally normal to said ring member axis, a piston mounted for reciprocal movement in said cylinder, a piston rod having a first end portion rigidly connected to said piston and a second end portion projecting outwardly of said cylinder, an engaging lever having means at a first end portion thereof for rotating said ring member, means at a second end portion of said engaging lever defining pivot connection means between said engaging lever second end portion and said piston rod second end portion, said piston having an exterior circumferential surface in generally sliding contact with said cylinder, said exterior circumferential surface being convexly curved thereby allowing an axis of said piston rod to take different nonparallel and nonconcentric positions relative to an axis of said cylinder, said pivot connection means including a pivot axis located at a fixed position relative to said engaging lever and said piston rod second end portion, said pivot connection means being constructed and arranged to effect angular movement between said engaging lever second end portion and said piston rod second end portion in response to all movements of said piston rod axis relative to said cylinder axis upon angular movement of said convexly curved surface relative to said cylinder, said pivot connection being a pivot pin articulately connecting said piston rod second end portion and said engaging lever second end portion, said piston rod second end portion being of a ball-like configuration, said engaging lever second end portion being in the form of a socket contoured at least in part to and housing said ball-like piston rod second end portion, and said socket including diverging wall portions diverging in a direction generally toward said piston.

2. The power wrench of claim 1 wherein said piston (36) has a single sealing groove at an equatorial portion of its circumferential surface, said sealing groove containing a sealing ring (39) biased radially outwardly.

3. The power wrench of claim 1 wherein said cylinder (2) is defined by a replaceable cylinder bushing (2) in said housing (10).

4. The power wrench of claim 3 wherein said cylinder bushing (20) is housed in a radial bore (27) of said housing (10).

5. The power wrench of claim 3, wherein a supporting bushing (25) is mounted within said housing (10) between said cylinder bushing (20) and said engaging lever (17), and said supporting bushing (25) is in axial abutment with said cylinder bushing (20).

6. The power wrench of claim 1, wherein spring means (43) is provided for urging said piston (36) away from said engaging lever (17).

7. The power wrench of claim 6, wherein said supporting bushing (20) has an inner shoulder (44) for supporting said spring (43).

8. The power wrench as defined in claim 1 including hydraulic means for normally urging said piston in a direction toward said ring member, and mechanical spring-biasing means for normally biasing said piston in a direction away from said ring member.

* * * * *